United States Patent [19]

Marteau d'Autry

[11] 4,362,064

[45] Dec. 7, 1982

[54] POSITIVE-DISPLACEMENT PIPETTE

[76] Inventor: Eric Marteau d'Autry, 72, rue Gambetta, Villiers-le-Bel, France, 95

[21] Appl. No.: 222,550

[22] Filed: Jan. 5, 1981

[30] Foreign Application Priority Data

Jan. 11, 1980 [FR] France ..... 80 00605

[51] Int. Cl.[3] ..... B01L 3/02

[52] U.S. Cl. ..... 73/864.13; 73/864.14

[58] Field of Search ..... 422/100; 73/863.13, 73/864.14

[56] References Cited

U.S. PATENT DOCUMENTS 4,023,716 5/1977 Shapiro ..... 73/864.14

4,084,730 4/1978 Franke et al. ..... 73/864.13

*Primary Examiner*—S. Clement Swisher

*Attorney, Agent, or Firm*—Mason, Kolehmainen, Rathburn & Wyss

[57] ABSTRACT

High-precision positive-displacement pipette having a nozzle with calibrated capillary channel and capable of disengageably fitting together with the free lower end of the pipette body. A piston fits tightly in the capillary channel and is controlled by a manually operable control rod equipped with a gripping device with which it grips the piston. An opening at this end of the body permits at least a part of the gripping device to pass through and come into contact with a stop provided on the inner surface of the nozzle so as to ensure the simultaneous ejection of the nozzle and of the piston which remains captive in the capillary channel.

13 Claims, 4 Drawing Figures

POSITIVE-DISPLACEMENT PIPETTE

BACKGROUND OF THE INVENTION

The present invention relates to an improvement, made to high-precision positive-displacement pipettes intended for the sampling and dispensing of small quantities of liquid.

In the prior art, such high-precision positive-displacement pipettes are already known and are of the type comprising a substantially tubular pipette body, at the lower end of which there is arranged a calibrated capillary tube in which a tight-fitting piston moves against an upward elastic restoring force exerted by a main spring, said piston being controlled in its downward displacement by a control rod projecting from the upper end of said pipette body, as well as an element gripping the upper end of the piston, said gripping element being of the type with resilient arms which move apart radially by displacement against the force exerted by a second spring of a resistance much higher than that of the main spring and said gripping element being solid with said control rod in translation. Such a positive-displacement pipette is described, for example, in Applicant's French Pat. No. 2446672.

The present improvement made to such a type of positive-displacement pepette lies mainly in a special arrangement thereof intended to permit a simultaneous ejection of the capillary nozzle and of the piston, without the operator having to manipulate the capillary and/or the piston directly. It is clear that, in the handling of radioactive samples or any other samples of contaminated liquid, it is crucial to be able easily to ensure such a simultaneous ejection of the capillary nozzle and of the piston which constitute the only elements of the pipette which are contaminated by the sampled liquid.

SUMMARY OF THE INVENTION

According to the present invention, the high-precision positive-displacement pipette is characterised in that it has a nozzle with calibrated capillary opening which is capable of cooperating, by fitting together, with the free lower end of the pipette body, the opening of this latter end permitting the passage of at least a part of the gripping element which, in the vicinity of the end of its downward stroke, come into contact with a stop provided on the inner surface of the nozzle to ensure the simultaneous ejection of said nozzle and of the piston which remains captive in the capillary opening.

A certain number of other characteristics and advantages of the positive-displacement pipette according to the invention will appear from a reading of the following detailed description with reference to the accompanying drawings.

DETAILED DESCRIPTION OF THE PREFERRED EMBODIMENT

Figure 1:
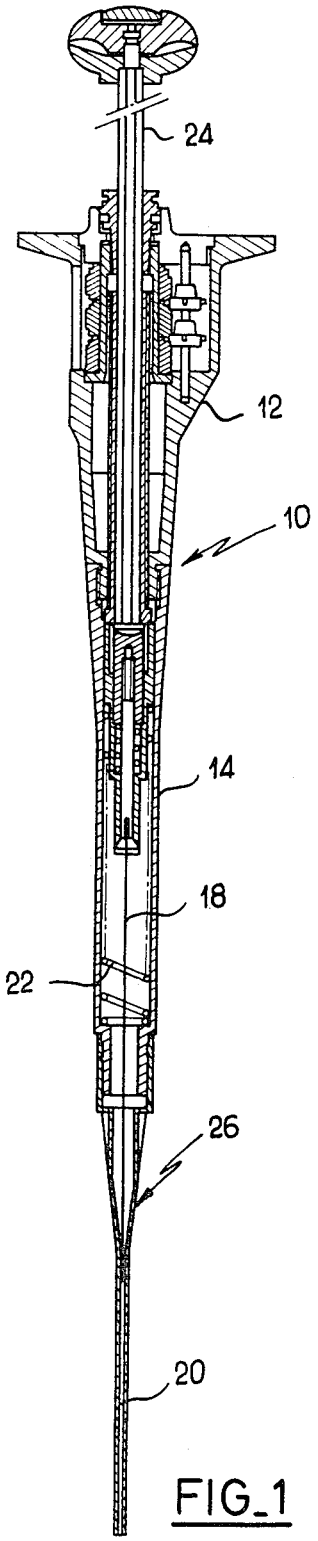
FIG. 1 shows a view in section of the whole of a positive-displacement pipette according to the invention.
Figure 2:
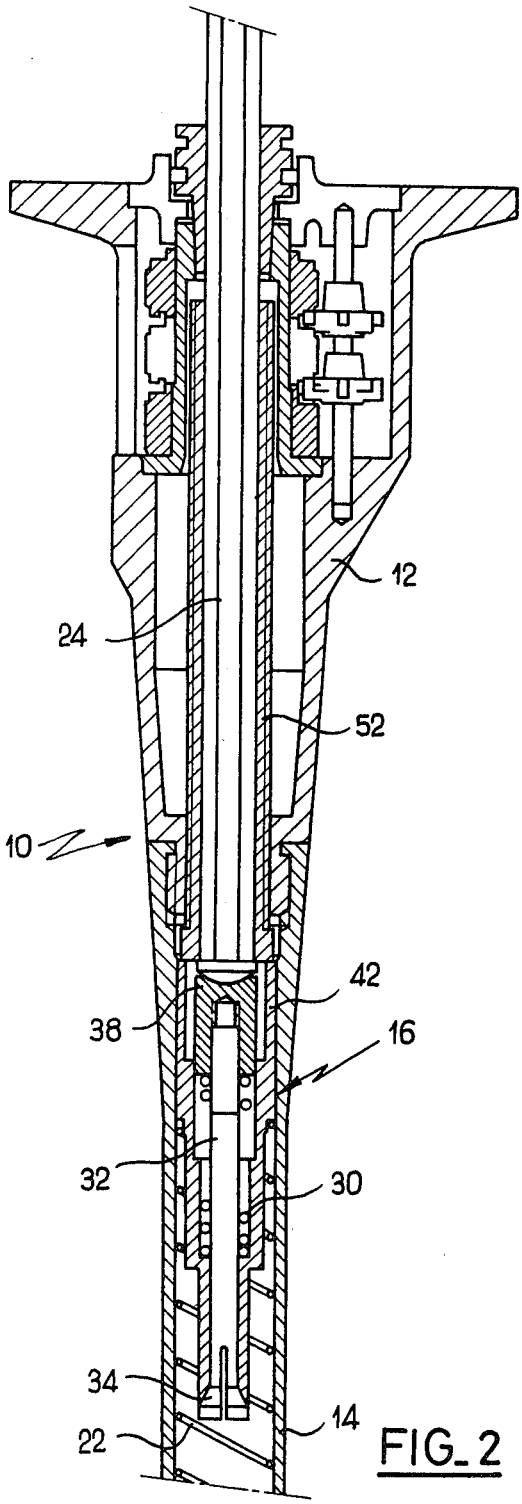
FIG. 2 shows a view on a larger scale of the upper scale of the upper part of the pipette illustrated in FIG. 1.

The positive-displacement pipette according to the invention comprises a substantially tubular body 10 which, in the particular embodiment described, is constituted in two separate parts made solid with one another by screwing. The upper part of the housing 12 incorporates, for example, a mechanism for adjusting and displaying the volume to be sampled and dispensed, and the lower tubular part 14 serves mainly for guiding the gripping element 16 of the piston 18. The special adjusting and display mechanism illustrated in FIGS. 1 and 2 is not part of the present invention and will therefore not be described here in detail. Such a mechanism is described in detail, for example, in copending U.S. Patent application Ser. No. 221,397, filed Dec. 31, 1980 entitled "Device for sampling and dispensing adjustable volumes of liquid, with numerical display", which is filed in the name of the Applicant and whose teaching is integrated in the present description.

As is conventional, there is arranged at the lower end of the part 14 of the pipette body 10 a calibrated capillary tube 20 in which a tight-fitting piston 18 moves against an upward elastic restoring force exerted by a main spring 22, said piston being controlled in its movement by a control rod 24 which projects from the upper end of the housing 12 of the pipette body 10.

Figure 4:
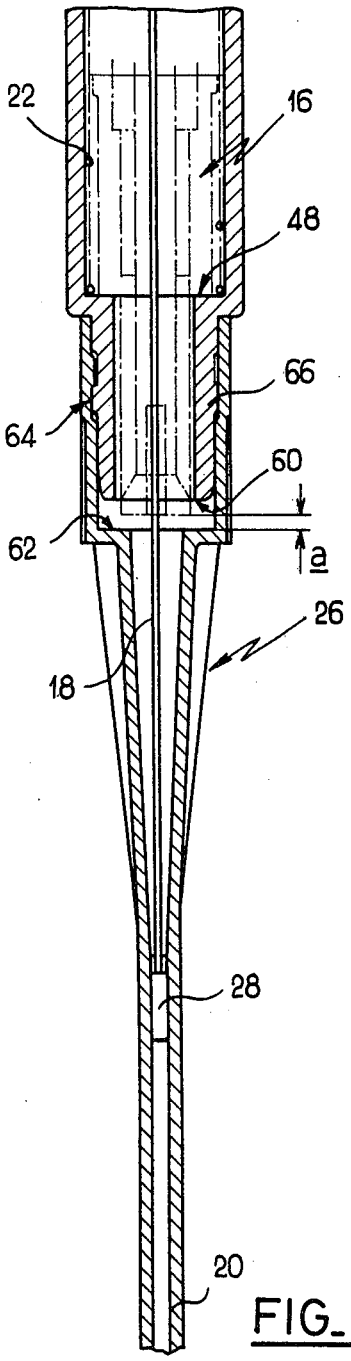
FIG. 4 shows a view on a larger scale of the lower part of the pipette, in which the cartridge gripper of FIG. 3 appears in dot-and-dash lines in its lower extreme position corresponding to the end of the ejection stroke.

According to the present invention, the pipette has a nozzle 26 which has a calibrated capillary through-opening 20 and which is capable of cooperating, by fitting together, with the free lower end of the pipette body 10. Advantageously, such a nozzle 26 will be made of a thermoplastic material selected to resist the samples with which it comes in contact. In such a type of pipette, it is essential that the piston 18 should have at least one tightly fitting region 28 which comes into close contact with the inner surface of the capillary tube 20. Such a piston 18 can, for example, be advantageously made in the form of a stainless steel wire which has a coating, for example a coating of Teflon, at the tightly fitting region 28. As is illustrated in FIGS. 1 and 4, such a coating can, for example, assume a general cylindrical form or can be provided on its periphery with at least one annular sealing lip which comes into close contact with the inner surface of the capillary tube 20.

Such a type of pipette likewise has a gripping element 16 for the upper end of the piston 18, said gripping element being of the type with resilient arms which move apart radially by displacement against the force exerted by a second spring 30 of a resistance much higher than that of the main spring 22. Such a gripping element 16 must clearly be solid with the control rod 24 of the pipette in translation.

According to a particular embodiment of the present invention, the gripping element 16 takes the form of an independent cartridge which comprises an actual gripper 32 termination at its lower end in resilient arms 34 and whose other end 36 is screwed into a gripper support 38. This gripper support 38 is capable of sliding, against the force exerted by the second spring 30 and in a part of its travel, in the upper part of the opening 40 in the gripper holder 42. This gripper holder 42 itself slides inside the lower part 14 of the pipette body 10 against the force exerted by the main spring 22. It is important that the end of the resilient arms 34 should have a surface which widens towards the outside and which is capable of being applied closely against the lower conical opening 44 of the gripper holder 42, this taking place under the action of the force exerted by the second spring 30. The actual cartridge is fitted in the following way. The gripper 32 is introduced via the lower conical opening 44 of the gripper holder 42, until the widened lower end of the resilient arms 34 comes to rest tightly against the lower conical opening 44 of the gripper holder 42. The second spring 30 is then introduced into the gripper holder 42 by its upper end and around the actual gripper 32, whereupon the gripper support 38 is screwed onto the actual gripper 32, whereupon the gripper support 38 is screwed onto the upper end 36 of the gripper 32, thus compressing the second spring 30.

Figure 3:
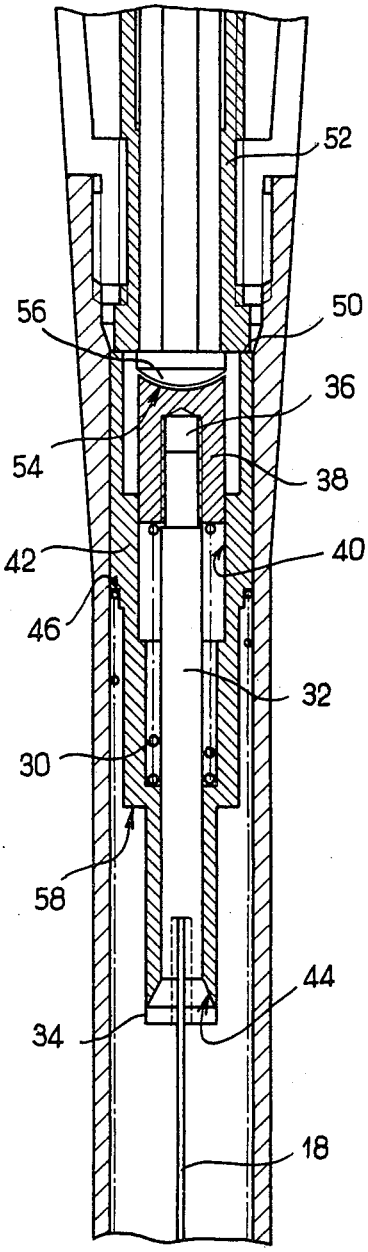
FIG. 3 shows a view on a larger scale of the gripping element made in the form of an independent cartridge.

It will be seen, for example in FIG. 3, that the whole of this cartridge which constitutes the gripping element 16 of the piston 18 is pressed resiliently upward under the action of the force exerted by the main spring 22. For this purpose, the gripper holder has a shoulder 46 against which the main spring 22 comes to bear. With its lower end the main spring 22 comes to bear fixedly on a shoulder 48 provided on the inner surface of the lower part 14 of the pipette body 10 in the vicinity of its free lower end. In the particular embodiment described, the gripper holder 42 comes to an upper stop at its upper free surface 50 against an adjusting screw 52 whose variable vertical position enables the effective travel for sampling and dispensing the liquid sample to be adjusted. It will be noted in FIG. 3 that the interaction of the control rod 24 and the gripping element 16 is effected at the upper surface of the gripper support 38 which advantageously takes the form of a spherical recess 54 which is capable of cooperating with a lower end, in the form of a ball-and-socket joint member 56, of the control rod 24.

Advantageously, a slight assembly play will be maintained between the ball-and-socket joint member 56 of the control rod 24 and the upper surface of the spherical recess 54 of the gripper holder 42, so as to ensure that the free upward travel-limiting stop is provided at the level of the contact between the gripper holder 42 and the adjusting screw 52 and not by means of the actual control rod 24. It should be noted here that the break between the gripping element 16 and the rest of the control rod 24 makes it possible, particularly making use of a ball-and-socket joint contact between these two elements, to avoid any problem in perfect alignment of the various components of the movable equipment of the pipette.

It will be clear that the particular embodiment discribedrelates to an adjustable pipette, that is to say a pipette whose upper stop for limiting the sampling travel is adjustable by the operator's acting on the screw 52 which is adjustable in the vertical position. However, the present invention is not limited to such a type of adjustable pipettes, but can also extend to fixed pipettes, that is to say to pipettes whose adjusting screw would be replaced by an upward travel-limiting stop which remains fixed in position in relation to the pipette body 10.

The stop for limiting the effective downward dispensing travel in the pipette is established at the level of a shoulder 58 provided in the vicinity of the lower part of the gripper holder 42. This shoulder 58 is capable of engaging with the corresponding shoulder 48 provided in the vicinity of the lower end of the pipette body 10. Such a lower extreme position of the gripper holder 42 is illustrated by dot-and-dash lines in FIG. 4. It will be noted that this position is obtained by complete compression of the main spring 22.

The opening 60 in the free lower end of the pipette body 10 is arranged so as to permit the passage of at least a part of the gripping element 16 which, at the end of its downward travel, comes in contact with a stop 62 provided on the inner surface of the nozzle 26. This special arrangement thus makes it possible to ensure the simultaneous ejection of said nozzle 26 and of the piston 18 which remains captive in the capillary opening 20.

In the particular embodiment described, the ends of the resilient arms 34 of the gripper 32 freely project from the conical lower end 44 of the gripper holder 42. The ejection of the nozzle 26 of the pipette is therefore obtained by exerting additional force on the control rod 24 which enables the second spring 30 to be compressed. The compression of this second spring 30 causes, beyond the position illustrated in FIG. 4, that is to say when the gripper holder 42 is against a lower stop, in the first place the parting of the resilient arms 34 which enables the piston 18 to be released. In the second place, the bearing of the free ends of the resilient arms 34, in the parted state, on the stop 62 provided on the inner surface of the nozzle 26 subsequently effects the actual ejection of the nozzle 26, in whose capillary opening 20 the piston 18 remains captive. According to an advantageous embodiment of the present invention, the stop 62 provided on the inner surface of the nozzle 26 takes the form of a surface offset towards the inside.

In order to ensure the simultaneous ejection of the capillary nozzle 26 and of the piston 18, said piston and its tightly fitting region 29 are arranged so that, at the end of the complete travel of the control rod 24, the piston 18 does not escape from the capillary opening 20 via the free lower end of same.

In the particular embodiment described, which has been entirely satisfactory in practice, the inner surface of the upper part of the nozzle 26 has at least one projecting or recessed annular zone 64 which is capable of engaging resiliently with a corresponding recessed or projecting annular zone 66 provided on the outer lateral surface of the lower part 14 of the pipette body 10. These projecting and recessed annular zones 64, 66 have been designed so as to permit a large range of guidance of the nozzle 26 on the end of the pipette, for example of the order of 5 to 10 mm and preferably 6 to 8 mm. In contrast, these projecting and recessed annular zones 64, 66 are likewise designed so as to ensure a slight engagement and disengagement travel of the nozzle 26, of the order of 2 mm.

Referring again to FIG. 4, it will be noted that the compression of the second spring 30 causes, first of all, a free travel of the order of 5 tenths of a millimeter, during which the resilient arms 34 of the gripper 32 move apart and release the piston 18. Then, if the second spring 30 continues to be compressed, a second travel is obtained of the order of 2.5 mm which, by contact of the end of the parted arms 34 of the gripper 32 with the inner surface of the stop 62 of the nozzle 26, ensures that the disengagement travel of the nozzle which is of the order of 2 mm is exceeded. Consequently, when the control rod 24 is completely compressed, that is to say when it compresses both the main spring 22 and the second spring 30, the sealing coating 28 of the piston 18 projects from the lower end of the capillary tube 20 by a length exactly equal to the distance a identified in FIG. 4, that is to say substantially 5 tenths of a millimeter.

The present invention is, of course, not limited to the particular embodiment described, but it is perfectly possible to conceive a certain number of variations in detail without thereby departing from the scope of the invention.

I claim:

1. A high-precision positive-displacement pipette for sampling and dispensing of small quantities of liquid, comprising:

a substantially tubular pipette body;

calibrated capillary means at the lower end of said pipette body;

tight fitting piston means movable in said capillary means;

main spring means exerting an upward elastic restoring force against said piston means;

a control rod projecting from the upper end of said pipette body;

means gripping the upper end of the piston means;

resilient members equipping said gripping means and movable apart radially by displacement;

second spring means having a resistance much higher than that of the main spring means and arranged for movement in translation with said control rod, said second spring means exerting a force opposing said displacement of said resilient members;

wherein the improvement comprises nozzle means associated with said capillary means and capable of engaging, by fitting together, with the free lower end of the pipette body, said lower end of the pipette body defining an opening permitting the passage of at least a part of said gripping means, and stop means provided on the inner surface of said nozzle means to come into contact with said gripping means and thereby ensure the simultaneous ejection of said nozzle and of the piston which remains captive in the capillary means.

2. A pipette as claimed in claim 1, wherein the inner surface of the upper part of the nozzle means has at least one projecting or recessed annular zone which is capable of interacting resiliently with a corresponding recessed or projecting annular zone provided on the outer lateral surface of the lower part of the pipette body.

3. A pipette as claimed in claim 2, wherein said projecting and recessed annular zones are designed so as to permit a large range of guidance of the nozzle means on the end of the pipette body of the order of 5 to 10 mm and a slight engagement and disengagement travel of the nozzle means of the order of 2 mm.

4. A pipette as claimed in claim 1, wherein the gripping means takes the form of a separate cartridge which comprises a gripper terminating at one end in resilient arms and whose other end is screwed into a gripper support which is capable of sliding, against a force exerted by the second spring means, partially in the upper part of the opening of a gripper holder which, in turn, slides on the inside of the pipette body against the force exerted by the main spring means and the end of each resilient arm has a widened surface which is applied closely against the conical lower opening of the gripper holder under the action of said second spring means.

5. A pipette as claimed in claim 4, wherein the interaction between the control rod and the gripping means is effected at the level of the upper surface of the gripper support.

6. A pipette as claimed in claim 5, wherein the upper surface of the gripper support has a spherical recess which is capable of interacting with a lower end, in the form of a ball-and-socket joint member, of the control rod.

7. A pipette as claimed in claim 4, wherein stop means limiting the upward effective travel in the pipette is provided at the level of the free upper surface of the gripper holder.

8. A pipette as claimed in claim 7, wherein a slight assembly play exists between the ball-and-socket joint member of the control rod and the upper surface of the spherical recess of the gripper support.

9. A pipette as claimed in claim 4, wherein stop means limiting the downward effective travel is provided at the level of a shoulder provided in the vicinity of the lower part of the gripper holder and capable of interacting with a corresponding shoulder provided in the vicinity of the lower end of the pipette body.

10. A pipette as claimed in claim 4, wherein the ends of the resilient arms of the gripper freely project from the conical lower end of the gripper holder.

11. A pipette as claimed in claim 9, wherein the ejection of said nozzle means is effected by compression of the second spring means causing, when the gripper holder is at the lower stop means, in the first place the parting of the resilient arms, thus releasing the piston means, and in the second place the bearing of the free ends of the resilient arms, in the parted state, on the stop means provided on the inner surface of the nozzle means.

12. A pipette as claimed in claim 11, wherein said stop means provided on the inner surface of the nozzle means takes the form of a surface offset towards the inside.

13. A pipette as claimed in claim 1, wherein the piston means is arranged in such a way that, at the end of the complete travel of the control rod, the piston means does not escape from the capillary means via the free lower end thereof.

* * * * *